US009494057B2

(12) United States Patent
Lee et al.

(10) Patent No.: US 9,494,057 B2
(45) Date of Patent: Nov. 15, 2016

(54) VARIABLE VALVE LIFT SYSTEM

(71) Applicant: Hyundai Motor Company, Seoul (KR)

(72) Inventors: Jangsu Lee, Yongin-si (KR); Hyounghyoun Kim, Hwaseong-si (KR); Hyosang Cho, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 42 days.

(21) Appl. No.: 14/555,418

(22) Filed: Nov. 26, 2014

(65) Prior Publication Data

US 2016/0090874 A1 Mar. 31, 2016

(30) Foreign Application Priority Data

Sep. 30, 2014 (KR) ..... 10-2014-0131634

(51) Int. Cl.
*F01L 1/18* (2006.01)
*F01L 1/24* (2006.01)
*F01L 1/14* (2006.01)

(52) U.S. Cl.
CPC ... *F01L 1/24* (2013.01); *F01L 1/14* (2013.01)

(58) Field of Classification Search
CPC ..... F01L 1/14; F01L 1/24
USPC ..... 123/90.39, 90.44, 90.45
See application file for complete search history.

(56) References Cited

U.S. PATENT DOCUMENTS 7,761,217 B2 * 7/2010 Waters ..... F01L 1/185 123/90.16

FOREIGN PATENT DOCUMENTS

| | | | |
|---|---|---|---|
| JP | 10-212913 | A | 8/1998 |
| JP | 2007-138787 | A | 6/2007 |
| JP | 4229902 | B2 | 2/2009 |
| JP | 2012-197697 | A | 10/2012 |
| KR | 10-0783541 | B1 | 12/2007 |
| KR | 10-2010-0130895 | A | 12/2010 |

* cited by examiner

*Primary Examiner* — Ching Chang
(74) *Attorney, Agent, or Firm* — Morgan, Lewis & Bockius LLP

(57) ABSTRACT

A variable valve lift system includes a camshaft, a high lift cam, a low lift cam, a valve lift apparatus including a high lift body driven by the high lift cam, a low lift body driven by the low lift cam, and a first coupling part to selectively couple the high lift body and the low lift body, a valve provided at one end of the low lift body and opened and closed by the low lift body, a hydraulic lash adjuster including an adjuster housing installed in a cylinder head, an adjust unit to support the other end of the low lift body, slidably provided within the adjuster housing, and to adjust clearance of the valve, and a second coupling part to selectively couple the adjust unit and the adjuster housing, and a hydraulic pressure supply unit to selectively supply hydraulic pressure to the first and second coupling parts.

21 Claims, 6 Drawing Sheets

VARIABLE VALVE LIFT SYSTEM

CROSS-REFERENCE TO RELATED APPLICATION

The present application claims priority to and the benefit of Korean Patent Application No. 10-2014-0131634 filed on Sep. 30, 2014, the entire contents of which is incorporated herein for all purposes by this reference.

BACKGROUND OF THE INVENTION

Field of the Invention

The present invention relates to a variable valve lift system and, more particularly, to a variable valve lift system capable of implementing four or more valve lifts.

Description of Related Art

An internal combustion engine receives fuel and air into a combustion chamber and burns the same to generate power. When taking in air, an intake valve is operated by driving of a camshaft, and while the intake valve is open, air is taken in to the combustion chamber. Also, an exhaust valve is operated by driving of the camshaft, and while the exhaust valve is open, air is discharged from the combustion chamber.

Here, however, optimal intake valve and exhaust valve operations are varied depending on a rotation speed of an engine. That is, an appropriate lift or valve opening/closing time is varied depending on a rotation speed of the engine. In order to implement appropriate valve operations according to rotation speeds of an engine, a variable valve lift (VVL) apparatus including a plurality of cams designed to have various shapes and driving a valve to be operated at different lifts according to RPMs of an engine has been studied.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable valve lift system having advantages of implementing four or more valve lifts.

An aspect of the present invention provides a variable valve lift system including a camshaft, a high lift cam provided in the camshaft, a low lift cam provided in the camshaft, a valve lift apparatus including a high lift body driven by the high lift cam, a low lift body driven by the low lift cam, and a first coupling part configured to selectively couple the high lift body and the low lift body, a valve provided at one end of the low lift body and opened and closed by the low lift body, a hydraulic lash adjuster (HLA) including an adjuster housing installed in a cylinder head, an adjust unit configured to support the other end of the low lift body, slidably provided within the adjuster housing, and configured to adjust clearance of the valve, and a second coupling part configured to selectively couple the adjust unit and the adjuster housing, and a hydraulic pressure supply unit configured to selectively supply hydraulic pressure to the first coupling part 30 and the second coupling part.

The first coupling part may include a first lock pin slidably provided within the low lift body, and a first elastic portion configured to elastically support the lock pin, wherein a first lost motion spring is provided between the high lift body and the low lift body to elastically support the high lift body and the low lift body, and when hydraulic pressure is supplied from the hydraulic pressure supply unit, the first lock pin juts out, so that the high lift body and the low lift body are driven together.

The adjust unit may include an inner plunger configured to support the low lift body and having inner oil supply holes and an inner oil discharge hole, an outer plunger configured to allow the inner plunger to be slidably inserted therein, having outer oil supply holes communicating with the inner oil supply holes, and having a hydraulic chamber communicating with an interior of the inner plunger through the inner oil discharge hole, a check ball provided within the hydraulic chamber and configured to selectively block the inner oil discharge hole, and a check ball elastic portion configured to elastically support the check ball, wherein the adjuster housing may include adjuster housing holes communicating with the outer oil supply holes.

The second coupling part may include a second lock pin slidably provided in the outer plunger, and a second elastic portion configured to elastically support the second lock pin, wherein the adjuster housing may have a lock pin hole, and when hydraulic pressure is supplied from the hydraulic pressure supply unit to the second lock pin, the second lock pin juts out and is inserted into the lock pin hole.

The adjust housing may include a second lost motion spring configured to elastically support the outer plunger.

The adjuster housing may include a stopper configured to limit movement of the outer plunger.

The oil supply unit may include an adjusting line supplying adjusting hydraulic pressure to the inner plunger, a first control line configured to supply oil to the first coupling part, a second control line configured to supply oil to the second coupling part, and a drain line discharging oil from the second coupling part.

The oil supply unit may further may include an oil control valve configured to selectively supply oil to the first control line and the second control line.

The oil control valve may include a control valve housing having an inlet configured to receive oil, a first outlet connected to the first control line, a second outlet connected to the second control line, and a return hole, and a control plunger slidably provided within the control valve housing and configured to selectively open and close the inlet, the first outlet, the second outlet, and the return hole.

In the control plunger, first, second, and third lands configured to selectively block the first and second outlets may protrusively be formed, a return line communicating a portion between the second land and the third land and the return hole may be formed, and oil supplied to the inlet may be discharged through the return hole, through the first outlet, through the first and second outlets, or through the second outlet, according to positions of the control plunger.

A position of the control plunger may be controlled by a solenoid or actuator.

According to positions of the control plunger, the high lift body and the low lift body are driven together and the position of the adjust unit may be fixed, the high lift body and the low lift body may be driven together and the adjust unit is in lost motion, the high lift body may be in lost motion and the position of the adjust unit may be fixed, or the high lift body is in lost motion and the adjust unit may be in lost motion.

Another embodiment of the present invention provides a variable value lift system including a camshaft including a high lift cam and a low lift cam, a valve lift apparatus including a high lift body driven by the high lift cam, a low lift body driven by the low lift cam, a first coupling part having a first lock pin slidably provided within the low lift body and configured to selectively couple the high lift body and the low lift body according to oil supply and a first elastic portion configured to elastically support the lock pin, and a first lost motion spring provided between the high lift body and the low lift body, a valve provided at one end of the low lift body and opened and closed by the low lift body, a hydraulic lash adjuster (HLA) including an adjuster housing installed in a cylinder head and having an adjuster housing hole and a lock pin hole, an adjust unit including an inner plunger configured to support the low lift body and having inner oil supply holes and an inner oil discharge hole, an outer plunger configured to allow the inner plunger to be slidably inserted therein, having outer oil supply holes communicating with the inner oil supply holes and the adjuster housing hole, and having a hydraulic chamber communicating with an interior of the inner plunger through the inner oil discharge hole, a check ball provided within the hydraulic chamber and configured to selectively block the inner oil discharge hole, and a check ball elastic portion configured to elastically support the check ball, and configured to adjust clearance of the valve, a second coupling part including a second lock pin slidably provided in the outer plunger and inserted into the lock pin hole according to oil supply, and a second elastic portion configured to elastically support the second lock pin, and a hydraulic pressure supply unit configured to selectively supply hydraulic pressure to the first coupling part and the second coupling part.

The oil supply unit may include an adjusting line supplying adjusting hydraulic pressure to the inner plunger, a first control line configured to supply oil to the first coupling part, a second control line configured to supply oil to the second coupling part, and a drain line discharging oil from the second coupling part.

The oil supply unit may further may include an oil control valve configured to selectively supply oil to the first control line and the second control line.

The oil control valve may include a control valve housing having an inlet configured to receive oil, a first outlet connected to the first control line, a second outlet connected to the second control line, and a return hole, and a control plunger slidably provided within the control valve housing and configured to selectively open and close the inlet, the first outlet, the second outlet, and the return hole.

In the control plunger, first, second, and third lands configured to selectively block the first and second outlets may protrusively be formed, a return line communicating a portion between the second land and the third land and the return hole may be formed, and oil supplied to the inlet may be discharged through the return hole, through the first outlet, through the first and second outlets, or through the second outlet, according to positions of the control plunger.

A position of the control plunger may be controlled by a solenoid or actuator.

According to positions of the control plunger, the high lift body and the low lift body are driven together and the position of the adjust unit may be fixed, the high lift body and the low lift body may be driven together and the adjust unit is in lost motion, the high lift body may be in lost motion and the position of the adjust unit is fixed, or the high lift body may be in lost motion and the adjust unit may be in lost motion.

The adjust housing may include a second lost motion spring configured to elastically support the outer plunger.

The adjuster housing may include a stopper configured to limit movement of the outer plunger.

According to the variable valve lift system of an embodiment of the present invention, four or more valve lifts can be implemented through a simple configuration.

According to the variable valve lift system of an embodiment of the present invention, four or more valve lift modes can be controlled with a single oil control valve.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
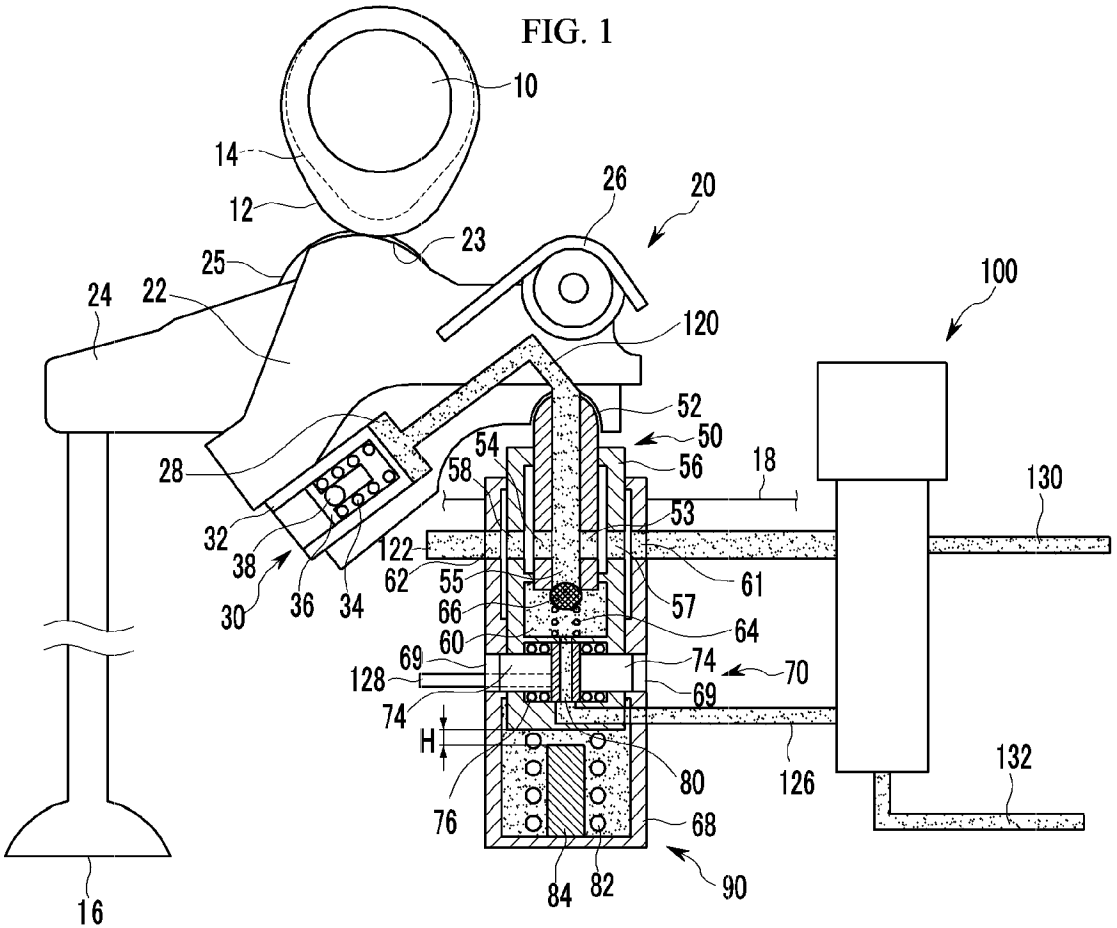
FIG. 1 is a front view of a variable valve lift system according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention Throughout the specification, like numbers refer to like elements.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification, unless explicitly described to the contrary, the word "comprise" and variations such as "comprises" or "comprising" will be understood to imply the inclusion of stated elements but not the exclusion of any other elements.

An exemplary embodiment of the present invention will hereinafter be described in detail with reference to the accompanying drawings.

Figure 2:
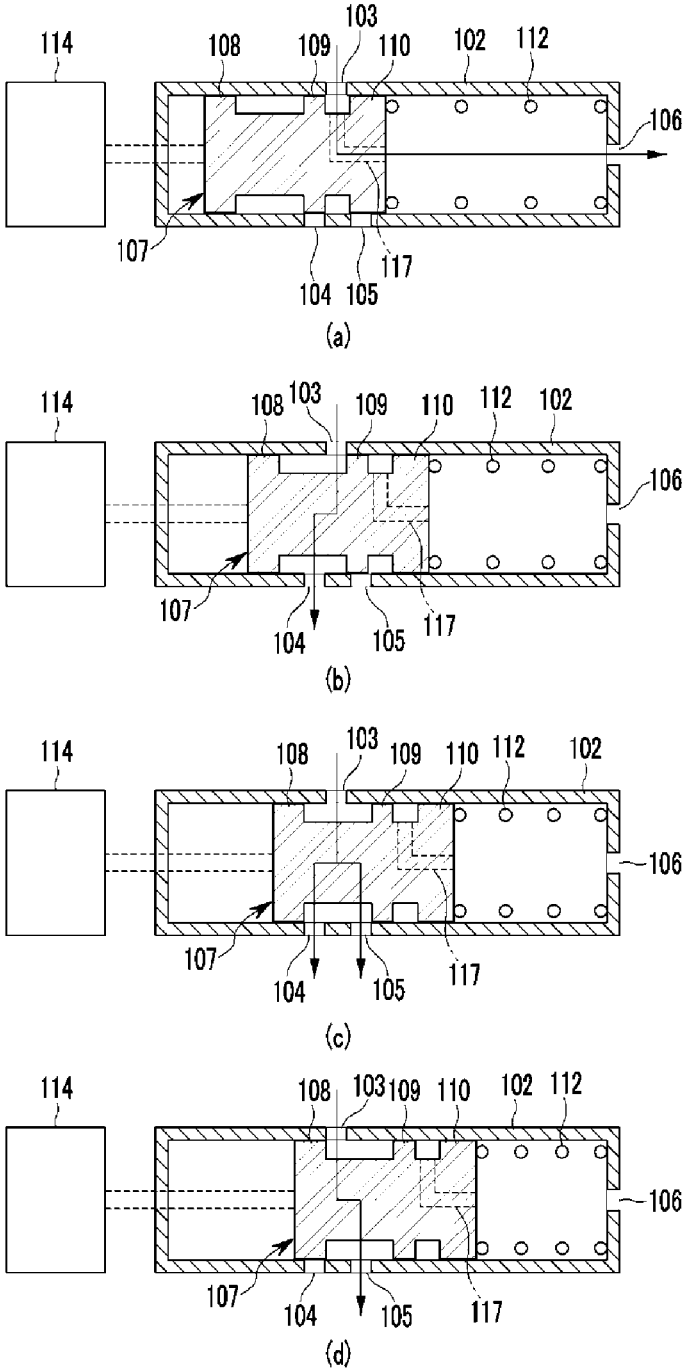
FIG. 2 is a view illustrating an oil control valve applicable to the variable valve lift system according to an exemplary embodiment of the present invention.

FIG. 1 is a front view of a variable valve lift system according to an exemplary embodiment of the present invention, and FIG. 2 is a view illustrating an oil control valve applicable to the variable valve lift system according to an exemplary embodiment of the present invention.

Referring to FIGS. 1 and 2, a variable value lift system according to an exemplary embodiment of the present invention includes a camshaft 10, a high lift cam 12 provided in the camshaft 10, a low lift cam 14 provided in the camshaft 10, a valve lift apparatus 20 including a high lift body 22 driven by the high lift cam 12, a low lift body 24 driven by the low lift cam 14, and a first coupling part 30 configured to selectively couple the high lift body 22 and the low lift body 24, a valve 16 provided at one end of the low lift body 24 and opened and closed by the low lift body 24, a hydraulic lash adjuster (HLA) 90 including an adjuster housing 68 installed in a cylinder head 18, an adjust unit 50 configured to support the other end of the low lift body 24, slidably provided within the adjuster housing 68, and configured to adjust clearance of the valve 16, a second coupling part 70 configured to selectively couple the adjust unit 50 and the adjuster housing 68, and a hydraulic pressure supply unit configured to selectively supply hydraulic pressure to the first coupling part 30 and the second coupling part 70.

A pad 23 may be formed on the high lift body 22 to allow the high lift cam 12 to be in contact with the pad 23 all the time, and a roller 25 may be provided in the low lift body 24 to allow the low lift cam 14 to be selectively brought into contact with the roller 25.

The first coupling part 30 includes a first lock pin 32 slidably provided within the low lift body 24 and a first elastic portion 34 configured to elastically support the lock pin 32, and a first lost motion spring 26 is provided between the high lift body 22 and the low lift body 24 to elastically support the high lift body 22 and the low lift body 24.

A first coupling part chamber 28 is formed in the low lift body 24, and the first lock pin 32 is slidably inserted into the first coupling part chamber 28. A spring sheet 36 is provided within the first lock pin 32 to support the first elastic portion 34, and the spring sheet 36 may be coupled to the low lift body 24 through a fixing pin 38.

When hydraulic pressure is supplied from the hydraulic pressure supply unit, the first lock pin 32 juts out from the first coupling part chamber 28, so that the high lift body 22 and the low lift body 24 can be driven together. That is, the valve 16 is opened and closed by the high lift cam 12.

When hydraulic pressure is not supplied from the hydraulic pressure supply unit, the first lock pin 32 enters the first coupling part chamber 28 by restoring force of the first elastic portion 34, and thus the high lift body 22 and the low lift body 24 are separated. That is, the high lift body 22 is in lost motion, and the valve 16 is opened and closed by the low lift cam 14.

The adjust unit 50 includes an inner plunger 52 configured to support the low lift body 24 and having inner oil supply holes 53 and 54 and an inner oil discharge hole 55, an outer plunger 56 configured to allow the inner plunger 52 to be slidably inserted therein, having outer oil supply holes 57 and 58 communicating with the inner oil supply holes 53 and 54, and having a hydraulic chamber 60 communicating with an interior of the inner plunger 52 through the inner oil discharge hole 55, a check ball 66 provided within the hydraulic chamber 60 and configured to selectively block the inner oil discharge hole 55, and a check ball elastic portion 64 configured to elastically support the check ball 66.

The adjuster housing 68 includes adjuster housing holes 61 and 62 communicating with the outer oil supply holes 57 and 58.

The second coupling part 70 includes a second lock pin 74 slidably provided in the outer plunger 56 and a second elastic portion 76 configured to elastically support the second lock pin 74. The adjuster housing 68 has a lock pin hole 69, and when hydraulic pressure is supplied from the hydraulic pressure supply unit to the second lock pin 74, the second lock pin 74 juts out and is inserted into the lock pin hole 69.

A second coupling part chamber 80 is formed in the outer plunger 56 to supply hydraulic pressure to the second lock pin 74, and when hydraulic pressure is supplied from the hydraulic pressure supply unit to the second coupling part chamber 80, the second lock pin 74 is inserted into the lock pin hole 69.

The adjuster housing 68 includes a second lost motion spring 82 configured to elastically support the outer plunger 56, and a stopper 84 configured to limit movement of the outer plunger 56.

The oil supply unit includes an adjusting line 122 supplying adjusting hydraulic pressure to the inner plunger 52, a first control line 124 configured to supply oil to the first coupling part 30, a second control line 126 configured to supply oil to the second coupling part 70, and a drain line 128 discharging oil from the second coupling part 70.

Hydraulic pressure supplied to the second coupling part chamber 80 is discharged through the drain line 128.

The oil supply unit further includes an oil control valve 100 configured to selectively supply oil to the first control line 124 and the second control line 126.

The oil control valve 100 includes a control valve housing 102 having an inlet 103 configured to receive oil from a main line 130, a first outlet 104 connected to the first control line 124, a second outlet 105 connected to the second control line 126, and a return hole 106 discharging hydraulic pressure from the interior of the coil control valve 100 to a release line 132, and a control plunger 107 slidably provided within the control valve housing 102 and configured to selectively open and close the inlet 103, the first outlet 104, the second outlet 105, and the return hole 106.

In the control plunger 107, first, second, and third lands 108, 109, and 110 configured to selectively block the first and second outlets 104 and 105 are protrusively formed, and a return line 117 communicating a portion between the second land 109 and the third land 110 and the return hole 106 is formed. Oil supplied to the inlet 103 may be discharged through the return hole 106, through the first outlet 104, through the first and second outlets 104 and 105, or through the second outlet 105, according to positions of the control plunger 107.

A plunger spring 112 configured to elastically support the plunger 107 may be provided within the control valve housing 102, and a solenoid or actuator 114 (hereinafter referred to as a 'solenoid') is provided, and thus a position of the control plunger 107 may be controlled according to actuation of the solenoid 114.

According to positions of the control plunger 107, the high lift body 22 and the low lift body 24 may be driven together and the position of the adjust unit 50 may be fixed, the high lift body 22 and the low lift body 24 may be driven together and the adjust unit 50 may be in lost motion, the high lift body 22 may be in lost motion and the position of the adjust unit 50 may be fixed, or the high lift body 22 may be in lost motion and the adjust unit 50 may be in lost motion.

Figure 3:
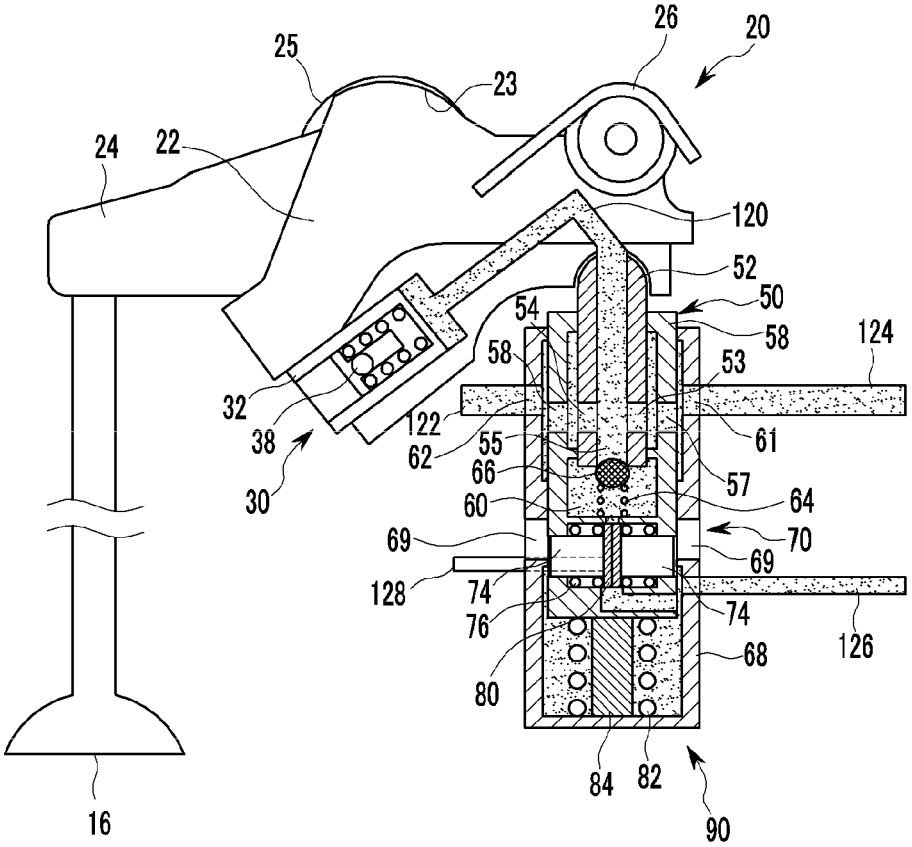
FIG. 3, FIG. 4 and FIG. 5 are views illustrating operations of the variable valve lift system according to an exemplary embodiment of the present invention.
Figure 4:
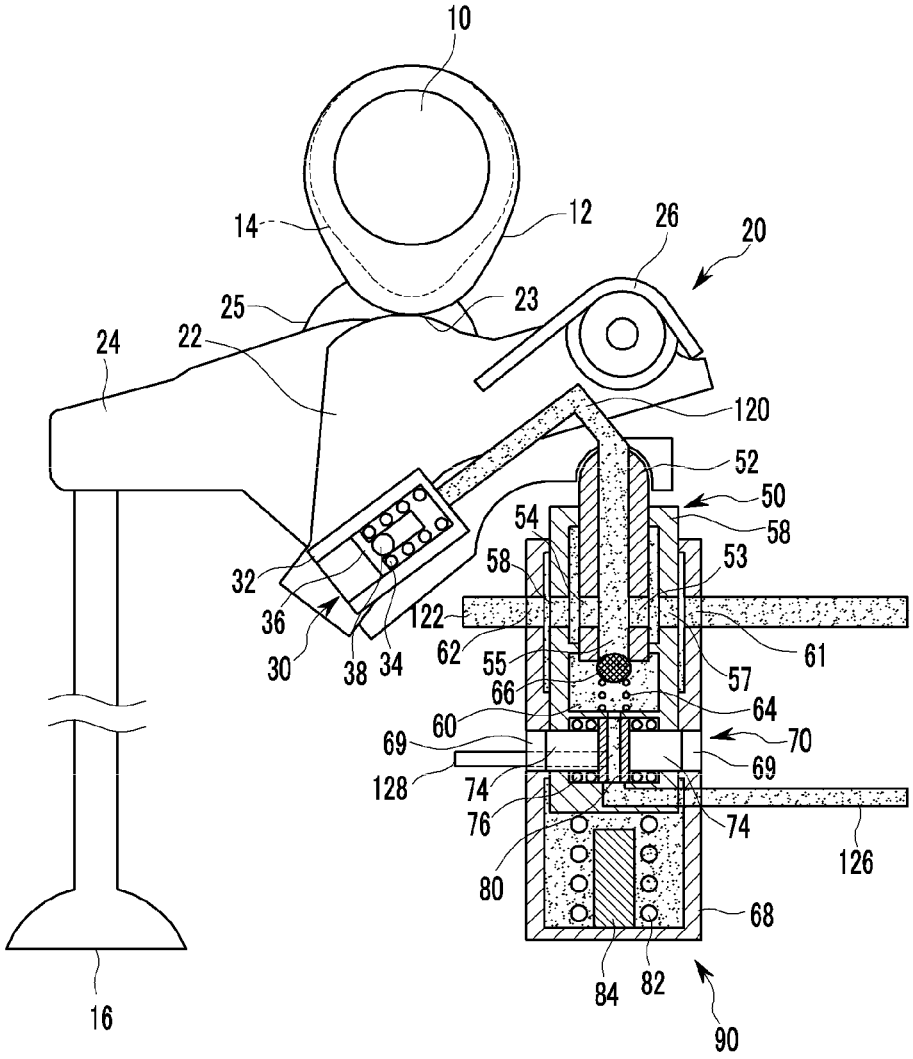
Figure 5:
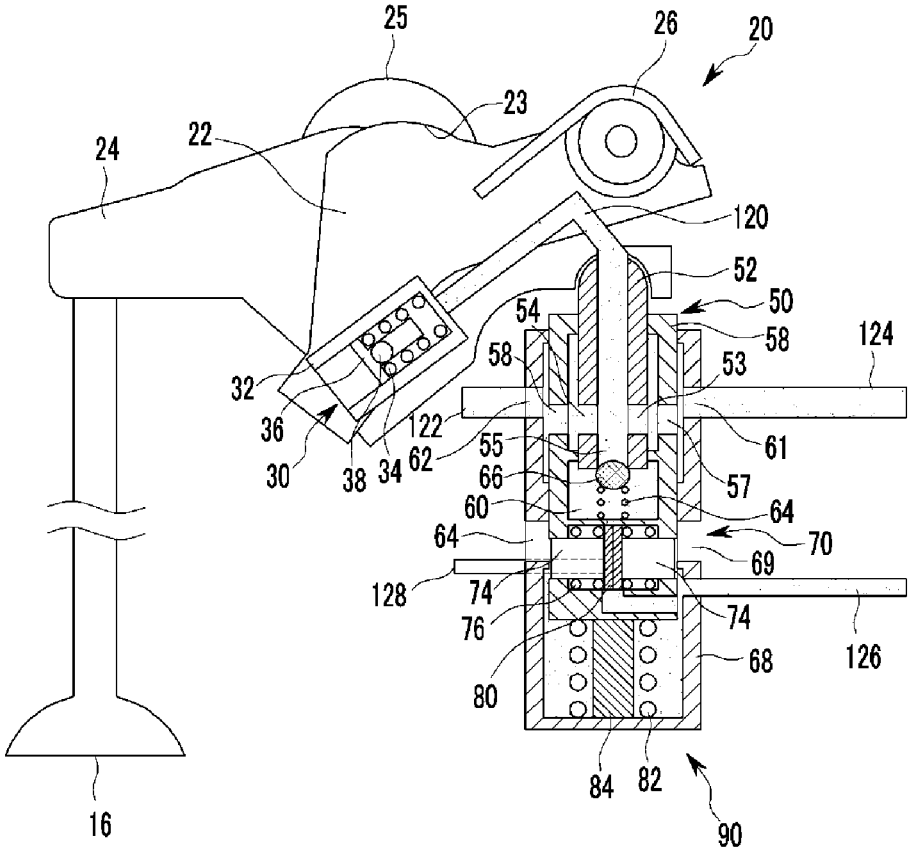

FIGS. 3 through 5 are views illustrating operations of the variable valve lift system according to an exemplary embodiment of the present invention.

Hereinafter, an operation of the variable value lift system according to an exemplary embodiment of the present invention will be described with reference to FIGS. 1 through 5.

Referring to (a) of FIG. 2 and FIG. 5, when the second and third lands 109 and 110 respectively block the first and second outlets 104 and 105 according to actuation of the solenoid 114, oil is not supplied to the first control line 124 or the second control line 126 but is discharged to the release line 132 through the return hole 106.

Then, the high lift body 22 is in lost motion and the adjust unit 50 is in lost motion.

Figure 6:
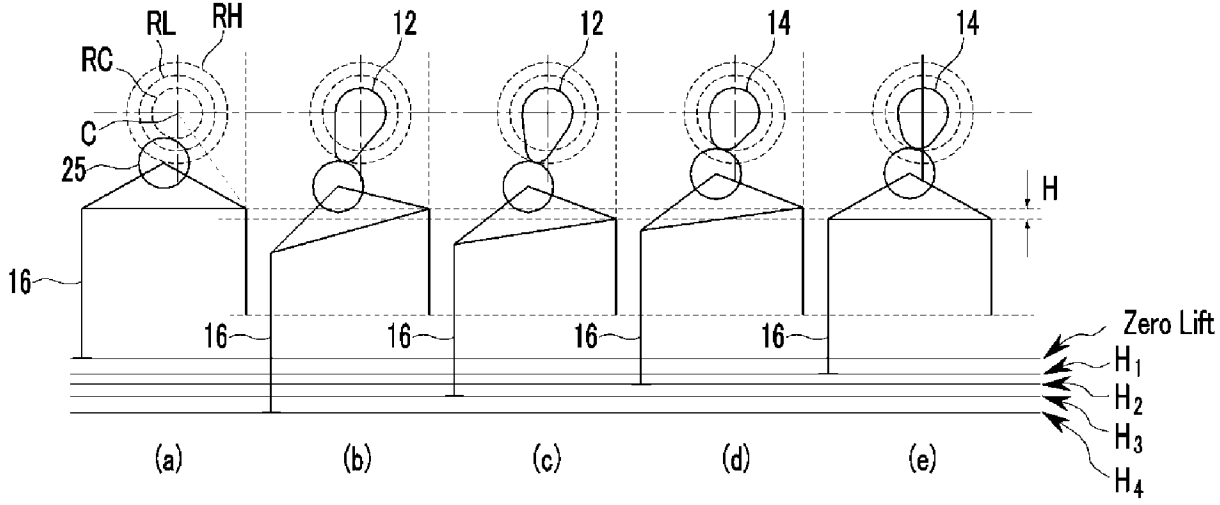
FIG. 6 is a view illustrating a change in a valve lift of the variable valve lift system according to an exemplary embodiment of the present invention.

FIG. 6 is a view illustrating a change in a valve lift of the variable valve lift system according to an exemplary embodiment of the present invention.

In FIG. 6, C denotes a rotation center of the camshaft 10, RC denotes a radius in contact with the roller 25, that is, a base circle of the high lift cam 12 and the low lift cam 14, RL denotes a rotation radius of the low lift cam 14, and RH denotes a rotation radius of the high lift cam 12.

In FIGS. 1 and 6, H denotes a distance between the stopper 84 and the bottom of the outer plunger 56, and also denotes a distance of lost motion of the adjust unit 50 when the adjust unit 50 is in lost motion.

When the control plunger 107 is positioned as illustrated in (a) of FIG. 2, lift of the valve 16 is implemented at H1.

Referring to (b) of FIG. 2 and FIG. 3, when the second land 109 blocks the second outlet 105 and discharging through the return hole is blocked according to actuation of the solenoid 114, oil is supplied to the first control line 124, and thus the high lift body 22 and the low lift body 24 are driven together and the adjust unit 50 is in lost motion.

Then, as illustrated in (c) of FIG. 6, lift of the valve 16 is implemented at H3.

Referring to (c) of FIG. 2 and FIG. 1, when oil is supplied to the first and second control lines 124 and 126 and discharging through the return hole 106 is blocked according to actuation of the solenoid 114, the high lift body 22 and the low lift body 24 are driven together and the position of the adjust unit 50 is fixed.

Then, as illustrated in (b) of FIG. 6, lift of the valve 16 is implemented at H4.

Referring to (d) of FIG. 4, when the first land 104 blocks the first outlet 104, discharging through the return hole 106 is blocked, and oil is supplied to the second control line 126 according to actuation of the solenoid 114, the high lift body 22 is in lost motion and the position of the adjust unit 50 is fixed.

Then, as illustrated in (d) of FIG. 6, lift of the valve 16 is implemented at H2.

Referring to FIG. 6, H4 denotes valve lift implemented by the lift cam 12 in a state in which the position of the adjust unit 50 is fixed, and H2 denotes valve lift implemented by the low lift cam 14 in a state in which the position of the adjust unit 50 is fixed.

H3 is an amount of lost motion of the adjust unit 50 at H4, that is, a difference of H, and H1 is an amount of lost motion of the adjust unit 50 at H2, that is, a difference of H.

When the amount of lost motion of the adjust unit 50, that is, H, is equal to or greater than H2, H1 becomes 0, that is, valve lift becomes 0, and thus the valve 16 is not opened or closed. Accordingly, in this case, the variable valve lift system according to an exemplary embodiment of the present invention may also implement cylinder deactivation.

In the drawings and detailed description, it is described that the valve lift apparatus implements 2-stage valve lift, but the present invention is not limited thereto, and three or more stages of valve lift may be implemented. For example, when the valve lift apparatus implements a 3-stage valve lift, the variable valve lift system according to an exemplary embodiment of the present invention may implement a total of six valve lifts.

As described above, the variable valve lift system according to an exemplary embodiment of the present invention can implement 4 or more stage valves of lift even without excessively changing a conventional valve train.

In addition, since various valve lifts can be implemented by a single oil control valve, production cost can be lowered.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A variable valve lift system comprising:

a camshaft;

a high lift cam provided in the camshaft;

a low lift cam provided in the camshaft;

a valve lift apparatus including a high lift body driven by the high lift cam, a low lift body driven by the low lift cam, and a first coupling member to selectively couple the high lift body and the low lift body;

a valve provided at one end of the low lift body and opened and closed by the low lift body;

a hydraulic lash adjuster (HLA) including an adjuster housing installed in a cylinder head, an adjust device to support another end of the low lift body, slidably provided within the adjuster housing, and to adjust clearance of the valve, and a second coupling member to selectively couple the adjust device and the adjuster housing; and a hydraulic pressure supply device to selectively supply hydraulic pressure to the first coupling member and the second coupling member.

2. The variable valve lift system of claim 1, wherein the first coupling member comprises:

a first lock pin slidably provided within the low lift body; and a first elastic portion elastically supporting the lock pin, wherein a first lost motion spring is provided between the high lift body and the low lift body to elastically support the high lift body and the low lift body, and when hydraulic pressure is supplied from the hydraulic pressure supply device, the first lock pin juts out, so that the high lift body and the low lift body are driven together.

3. The variable valve lift system of claim 1, wherein the adjust device comprises:

an inner plunger supporting the low lift body and having inner oil supply holes and an inner oil discharge hole;

an outer plunger allowing the inner plunger to be slidably inserted therein, having outer oil supply holes communicating with the inner oil supply holes, and having a hydraulic chamber communicating with an interior of the inner plunger through the inner oil discharge hole;

a check ball provided within the hydraulic chamber to selectively block the inner oil discharge hole; and a check ball elastic portion elastically supporting the check ball, wherein the adjuster housing comprises adjuster housing holes communicating with the outer oil supply holes.

4. The variable valve lift system of claim 3, wherein the second coupling member comprises:

a second lock pin slidably provided in the outer plunger; and a second elastic portion elastically supporting the second lock pin, wherein the adjuster housing has a lock pin hole, and when hydraulic pressure is supplied from the hydraulic pressure supply device to the second lock pin, the second lock pin juts out and is inserted into the lock pin hole.

5. The variable valve lift system of claim 4, wherein the adjust housing includes a second lost motion spring elastically supporting the outer plunger.

6. The variable valve lift system of claim 4, wherein the adjuster housing includes a stopper to limit movement of the outer plunger.

7. The variable valve lift system of claim 3, wherein the oil supply device comprises:

an adjusting line supplying adjusting hydraulic pressure to the inner plunger;

a first control line supplying oil to the first coupling member;

a second control line supplying oil to the second coupling member; and a drain line discharging oil from the second coupling member.

8. The variable valve lift system of claim 7, wherein the oil supply device further comprises:

an oil control valve selectively supplying oil to the first control line and the second control line.

9. The variable valve lift system of claim 8, wherein the oil control valve comprises:

a control valve housing having an inlet to receive oil, a first outlet connected to the first control line, a second outlet connected to the second control line, and a return hole; and a control plunger slidably provided within the control valve housing to selectively open and close the inlet, the first outlet, the second outlet, and the return hole.

10. The variable valve lift system of claim 9, wherein in the control plunger, first, second, and third lands selectively blocking the first and second outlets are protrusively formed, a return line communicating a portion between the second land and the third land and the return hole is formed, and oil supplied to the inlet is discharged through the return hole, through the first outlet, through the first and second outlets, or through the second outlet, according to positions of the control plunger.

11. The variable valve lift system of claim 10, wherein a position of the control plunger is controlled by a solenoid or actuator.

12. The variable valve lift system of claim 10, wherein, according to positions of the control plunger, the high lift body and the low lift body are driven together and the position of the adjust device is fixed, the high lift body and the low lift body are driven together and the adjust device is in lost motion, the high lift body is in lost motion and the position of the adjust device is fixed, or the high lift body is in lost motion and the adjust device is in lost motion.

13. A variable valve lift system comprising:

a camshaft including a high lift cam and a low lift cam;

a valve lift apparatus including a high lift body driven by the high lift cam, a low lift body driven by the low lift cam, a first coupling member having a first lock pin slidably provided within the low lift body to selectively couple the high lift body and the low lift body according to oil supply and a first elastic portion elastically supporting the lock pin, and a first lost motion spring provided between the high lift body and the low lift body;

a valve provided at one end of the low lift body and opened and closed by the low lift body;

a hydraulic lash adjuster (HLA) including an adjuster housing installed in a cylinder head and having an adjuster housing hole and a lock pin hole, an adjust device including an inner plunger supporting the low lift body and having inner oil supply holes and an inner oil discharge hole, an outer plunger allowing the inner plunger to be slidably inserted therein, having outer oil supply holes communicating with the inner oil supply holes and the adjuster housing hole, and having a hydraulic chamber communicating with an interior of the inner plunger through the inner oil discharge hole, a check ball provided within the hydraulic chamber and selectively blocking the inner oil discharge hole, and a check ball elastic portion elastically supporting the check ball, and adjusting clearance of the valve, a second coupling member including a second lock pin slidably provided in the outer plunger and inserted into the lock pin hole according to oil supply, and a second elastic portion elastically supporting the second lock pin; and a hydraulic pressure supply device selectively supplying hydraulic pressure to the first coupling member and the second coupling member.

14. The variable valve lift system of claim 13, wherein the hydraulic pressure supply device comprises:

an adjusting line supplying adjusting hydraulic pressure to the inner plunger;

a first control line supplying oil to the first coupling member;

a second control line supplying oil to the second coupling member; and a drain line discharging oil from the second coupling member.

15. The variable valve lift system of claim 14, wherein the hydraulic pressure supply device further comprises an oil control valve selectively supplying oil to the first control line and the second control line.

16. The variable valve lift system of claim 15, wherein the oil control valve comprises:

a control valve housing having an inlet to receive oil, a first outlet connected to the first control line, a second outlet connected to the second control line, and a return hole; and a control plunger slidably provided within the control valve housing to selectively open and close the inlet, the first outlet, the second outlet, and the return hole.

17. The variable valve lift system of claim 16, wherein, in the control plunger, first, second, and third lands selectively blocking the first and second outlets are protrusively formed, a return line communicating a portion between the second land and the third land and the return hole is formed, and oil supplied to the inlet is discharged through the return hole, through the first outlet, through the first and second outlets, or through the second outlet, according to positions of the control plunger.

18. The variable valve lift system of claim 17, wherein a position of the control plunger is controlled by a solenoid or actuator.

19. The variable valve lift system of claim 17, wherein, according to positions of the control plunger, the high lift body and the low lift body are driven together and the position of the adjust device is fixed, the high lift body and the low lift body are driven together and the adjust device is in lost motion, the high lift body is in lost motion and the position of the adjust device is fixed, or the high lift body is in lost motion and the adjust device is in lost motion.

20. The variable valve lift system of claim 13, wherein the adjust housing includes a second lost motion spring elastically supporting the outer plunger.

21. The variable valve lift system of claim 13, wherein the adjuster housing includes a stopper to limit movement of the outer plunger.

* * * * *